US005150587A

United States Patent [19]

Bergmann

[11] Patent Number: 5,150,587

[45] Date of Patent: Sep. 29, 1992

[54] WARP KNITTING MACHINE PROCESS AND THE PILE WARE PRODUCED THEREBY

[75] Inventor: Gerhard Bergmann, Heusenstamm, Fed. Rep. of Germany

[73] Assignee: Karl Mayer Textilmaschinenfabrik GmbH, Obertschausen, Fed. Rep. of Germany

[21] Appl. No.: 638,640

[22] Filed: Jan. 8, 1991

[30] Foreign Application Priority Data

Jan. 20, 1990 [DE] Fed. Rep. of Germany ..... 4001621

[51] Int. Cl.[5] ..... D04B 21/02

[52] U.S. Cl. ..... 66/195; 66/84 R; 66/204

[58] Field of Search ..... 66/84 R, 203, 204, 205, 66/207, 214, 91, 194, 195

[56] References Cited

U.S. PATENT DOCUMENTS

| | | | |
|---|---|---|---|
| 3,834,193 | 9/1974 | Wilkens | 66/84 RX |
| 4,197,725 | 4/1980 | Kohl | 66/195 X |
| 4,266,411 | 5/1981 | Lindner et al. | 66/203 X |
| 4,297,858 | 11/1981 | Blasberg et al. | 66/194 |
| 4,302,953 | 12/1981 | Wilkens | 66/194 X |
| 4,315,419 | 2/1982 | Kernbichler et al. | 66/194 X |
| 4,331,009 | 5/1982 | Kohl | 66/203 |
| 4,449,382 | 5/1984 | Kohl | 66/203 |
| 4,549,414 | 10/1985 | Zorini et al. | 66/203 |
| 4,570,462 | 2/1986 | Roth | 66/204 |
| 4,581,905 | 4/1986 | Bonaschi | 66/203 |
| 4,805,424 | 2/1989 | Charkovsky | 66/194 |
| 4,986,091 | 1/1991 | Jager | 66/204 X |

FOREIGN PATENT DOCUMENTS

| | | |
|---|---|---|
| 0286461 | 12/1988 | European Pat. Off. . |
| 2435312 | 10/1979 | Fed. Rep. of Germany . |

*Primary Examiner*—Werner H. Schroeder
*Assistant Examiner*—John J. Calvert
*Attorney, Agent, or Firm*—Omri M. Behr

[57] ABSTRACT

A warp knitting machine for making pile ware having at least two guide bars carrying guides (L1, L2, L3) and a pile sinker bar (5) carrying pile sinkers displaceable in the longitudinal direction. The guides lay the threads forming the ground ware without crossing over the pile sinkers and lay the threads forming the pile loops by crossing over the pile sinkers. At least one guide bar (L1, L2) is equipped as a jacquard guide bar. The displacement of this guide bar, is so chosen that, in dependence upon the jacquard controls (9), the guides (6,7) can lay either a ground ware (15) or pile loops (14).

15 Claims, 6 Drawing Sheets

WARP KNITTING MACHINE PROCESS AND THE PILE WARE PRODUCED THEREBY

BACKGROUND OF THE INVENTION

The present invention relates to a warp knitting machine for the production of pile ware having at least two guide bars carrying guides and a pile sinker bar carrying pile sinkers displaceable in the longitudinal direction. The guides lay the threads for the formation of (a) the ground ware, without crossing over the pile sinkers and (b) pile loops by crossing over the pile sinkers. The present invention also relates to a process for forming warp knitted pile ware by using such a warp knitting machine and to the pile ware itself produced on such a machine.

Warp knitting machines of the foregoing type are generally known, as disclosed in German Patent 24 35 312. This patent shows a first guide bar for the production of tricot ground ware and a second guide bar for the formation of pile loops. This patent also shows a pile sinker bar displaceable in the longitudinal direction, whose pile sinkers reach into the needle gaps and continually remain there. The patterning possibilities of such a device are minimal.

EP published application 286 461 discloses a process for the preparation of pile ware, which employs three or more guide bars which can lay not only the ground ware but also the pile loops. This is achieved by subjecting the guide bars to a sequential displacement, where in one sequence the guide bars as well as the pile sinker bar are displaced. In a subsequent sequence everything other than the pile sinker bar is displaced. Where different thread systems are supplied to the guide bars, there is provided a pile with a diagonal striped pattern.

An object of the present invention is to provide pile ware having a plurality of patterning possibilities. This task is solved by providing the warp knitting machine of the prior art with at least one guide bar equipped as a jacquard guide bar with laterally displaceable guides. The ground displacement of this guide bar is so chosen that, in dependence upon the jacquard controls, it can lay either ground ware or pile loops.

SUMMARY OF THE INVENTION

In accordance with the illustrative embodiments demonstrating features and advantages of the present invention, there is provided a warp knitting machine for producing pile ware with threads. The machine has a pile sinker bar having a plurality of pile sinkers displaceable in the longitudinal direction. The machine also has at least two guide bars, each having a plurality of guides. At least one of the guide bars (a) comprises a jacquard guide bar means for displacing its guides and (b) is arranged to shog by an amount that selectively produces, in dependence upon the jacquard guide means, either ground ware or pile loops. The ground ware is formed by laying the threads without crossing over the pile sinkers. The pile loops are formed by laying the threads across the pile sinkers.

A related process of the same invention can produce warp knitted pile ware utilizing a warp knitting machine having a pile sinker bar, and at least two guide bars, at least one being a jacquard guide bar having a jacquard control system. The process includes the step of laying threads with the jacquard guide bar to form ground ware, under the influence of the jacquard control system. The process also includes the step of alternately laying threads with the jacquard guide bar to form pile loops, under the influence of the jacquard control system.

Related pile ware of the same invention is produced by a warp knitting machine having a pile sinker bar, and at least two guide bars, at least one being a jacquard guide bar having a jacquard control system. The pile ware includes ground ware and pile loops arranged with areas having pile loops and alternate areas devoid of pile loops.

Alternate pile ware of the same invention is produced by the last mentioned warp knitting machine. The pile ware includes ground ware and pile loops from two thread systems. The pile ware has an area either devoid of pile loops or occupied by pile loops from one of the thread systems. The other one of the thread systems provides an alternate area with pile loops.

A process for the formation of warp knitted pile ware utilizing a warp knitting machine of the foregoing type is characterized thereby that each jacquard guide bar is provided with a thread system whose threads are caused, by means of jacquard controls, to alternate between ground ware and pile loops. Thus, two jacquard guide bars can be provided with different thread systems whose threads alternate as pile loops. It is possible to provide a single thread system of at least two pattern forming thread types. Furthermore, two jacquard guide bar thread systems can be provided whose threads, by means of the jacquard controls, can form pile loops, either alternately or at the same time.

By employing techniques of the foregoing type, an extraordinary number of patterning possibilities are made available. In the thus produced pile ware there are areas with and area without pile loops. There may be areas having double pile loops, areas with single pile loops and/or areas devoid of pile loops. By utilizing a two thread system, areas may be provided having pile loops of one of said thread systems and areas with pile loops from the other thread system and/or areas devoid of pile loops.

Although the displacement stroke of a jacquard control is rather small (generally being only one needle space), this displacement is sufficient however, during the ground displacement of the jacquard guide bar, to provide, as chosen, either ground ware or pile loops. Thus, by utilizing an appropriate jacquard control program, it is possible to provide patterning both in the warp direction, as well as in the weft direction. In the simplest case, this gives rise to an unrestricted high and low patterning in the areas where the presence and absence of pile loops alternate.

It is particularly advantageous if the ground displacement of the jacquard guide bar corresponds to the displacement of the pile sinker bar. This means that the jacquard guide bar lays the ground ware with the undisplaced guides and always then, when commanded by the jacquard control arrangement, lays pile loops.

In a preferred embodiment, two jacquard guide bars are provided which, in dependence upon the jacquard controls, as chosen, lay ground ware or pile loops. This raises the patterning possibilities.

In another embodiment, a third guide bar is provided for the formation of the ground ware, which is equipped with fixed guides. The two jacquard guide bars are so controlled that, as chosen, they can form the pile loops. This means that there are provided alternate areas with double pile loops and areas with single pile loops and/or areas with no pile loops. It is thus possible to provide three topographically differentiable patterning possibilities.

In yet another embodiment, both guide bars are so controllable that, as chosen, the first or the second guide bar lays the pile loops while the other lays the ground ware. It is thus possible to obtain with only two guide bars a continuous pile ware with alternating pile loops. By the provision of a dual thread system, it is possible to change between: areas with pile loops from one thread system; areas with pile loops from the other thread system; and/or areas without pile loops. Here with only two different but in fact unitary, thread systems, there are a plurality of patterning possibilities.

It should be noted in the foregoing that the area change can take place in the warp direction as well as perpendicular thereto. It should further be noted that the individual thread systems can be set up in a patterning manner which readily gives rise to an extraordinary number of patterning possibilities.

BRIEF DESCRIPTION OF THE DRAWINGS

The invention are exemplified in the drawings which are summarized herein below.

DETAILED DESCRIPTION OF THE PREFERRED EMBODIMENT

Figure 1:
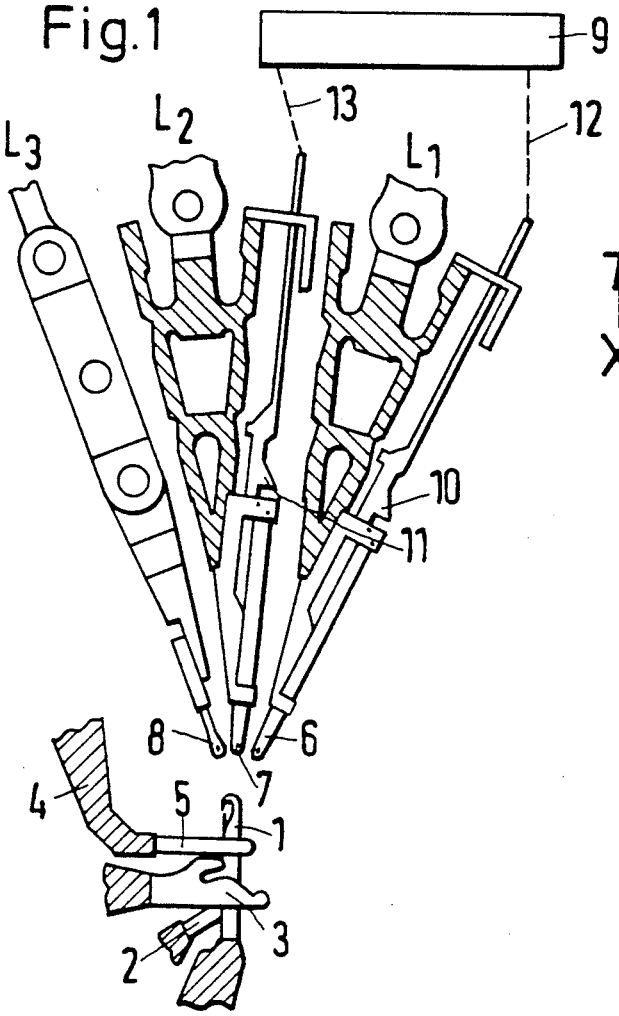
FIG. 1 is a schematic, elevational, cross-sectional view through the working area of a warp knitting machine in accordance with the principles of the present invention.

The working area of a warp knitting machine illustrated in FIG. 1 shows, in the conventional manner, a row of needles 1 each provided with a slider 2 and the appropriate closing knock-off sinker 3. Additionally, a pile sinker bar 4 is provided whose sinkers 5 reach into the needle spaces and permanently remain therein. Located over the needles are three guide bars L1, L2 and L3 which carry guides 6, 7 and 8, respectively. The guide bars L1 and L2 are provided as jacquard guide bars. This means that each guide 6 and 7 can be displaced by one needle space in dependence upon the jacquard control arrangement 9. For this purpose the appropriate displacement sinkers 10 or 11 are activated by the jacquard arrangement 9 by means of harness cords 12 or 13 or other similar activating elements.

Figure 2:
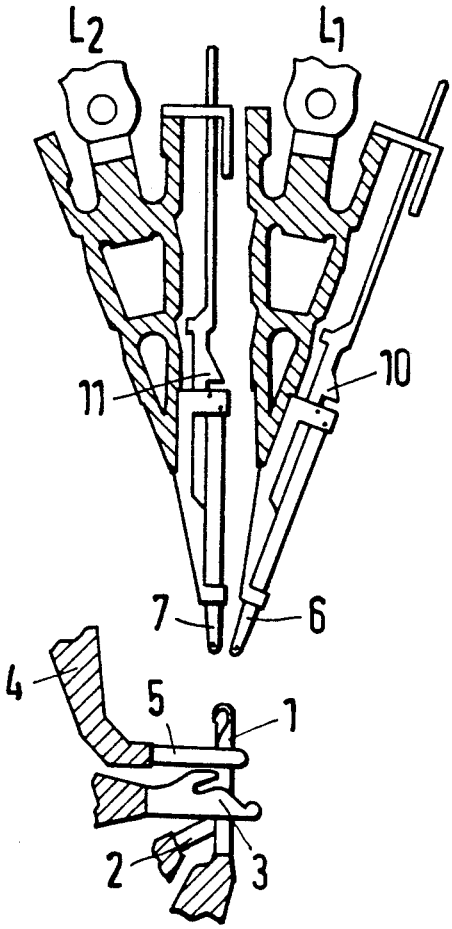
FIG. 2 is a view of a working area which is an alternate to that of FIG. 1.

The jacquard arrangement 9 can be activated in the conventional mechanical way by means of punch cards, electromagnetically by means of a computer, or any other well known means so that the displacement sinkers 10 and 11 at each guide bar L1 and L2 can be activated at will FIG. 2 differs from FIG. 1 only in so far as guide bar L3 is not present.

Figure 3:
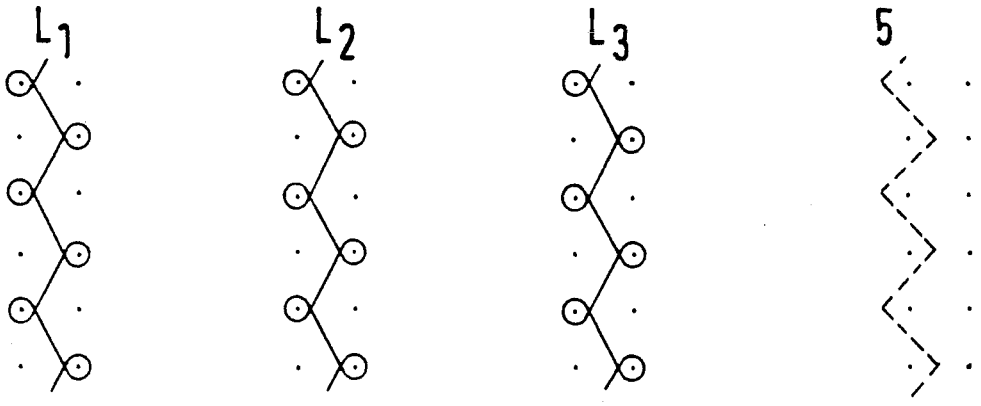
FIG. 3 is a lapping diagram for the ground stitch of all of the bars of FIG. 1.

FIG. 3 shows the ground stitch of all of the three guide bars L1, L2 and L3 as tricot stitches in which the thread is alternately laid about neighboring needles 1. The guides can be threaded at every needle space. The tricot alternation between two needles spread apart by one needle space further corresponds to the displacement of the pile sinker 5, which is shown in phantom on the right of FIG. 3. As a consequence thereof, there is no crossing of the threads over the pile sinkers. All three guide bars form the ground wear together. This ground displacement is caused by pattern wheels or the like which interact with the ends of the individual bars.

Figure 7:
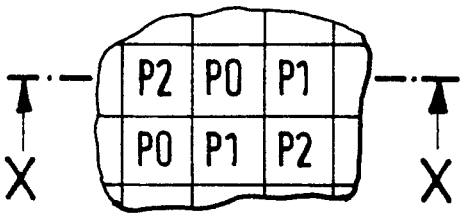
FIG. 7 is a schematic plan view of a fragment of the goods produced with the warp knitting machine of FIG. 1.
Figure 8:
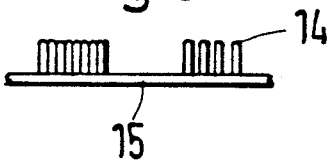
FIG. 8 is a cross-sectional view of the goods taken along line X—X of FIG. 7.
Figure 4:
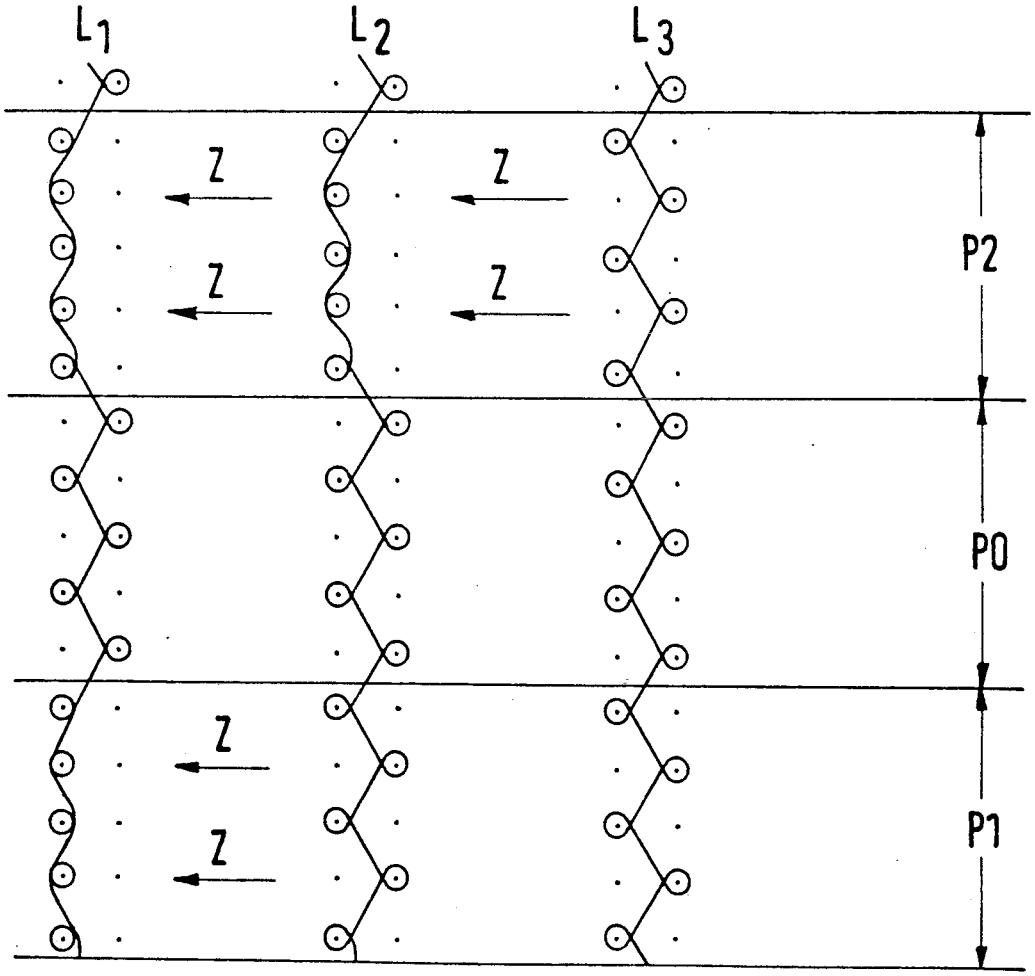
FIG. 4 is a lapping diagram for various working cycles of the warp knitting machine of FIG. 1.

FIG. 4 shows that guide bar L3, comprising fixed guides 8, produces tricot ground wear as before. With respect to the jacquard control guide bars L1 and L2 where, as illustrated by arrow 7, there is a displacement of guides 6 and 7 by one needle space, a pillar stitch is provided. The pillar threads cross over the pile sinkers 5 so that at these points pile loops are made. There is thus produced an area P2 with double pile loops, an area P1 with single pile loops, and an area P0 with no pile loops. As illustrated in FIGS. 7 and 8, the areas with varying pile densities can be arranged in patterns that vary in both the warp and weft directions. FIG. 8 illustrates that area P2 contains twice as many pile loops 14 as area P1 and that in area P0 the ground ware is pile free.

Figure 5:
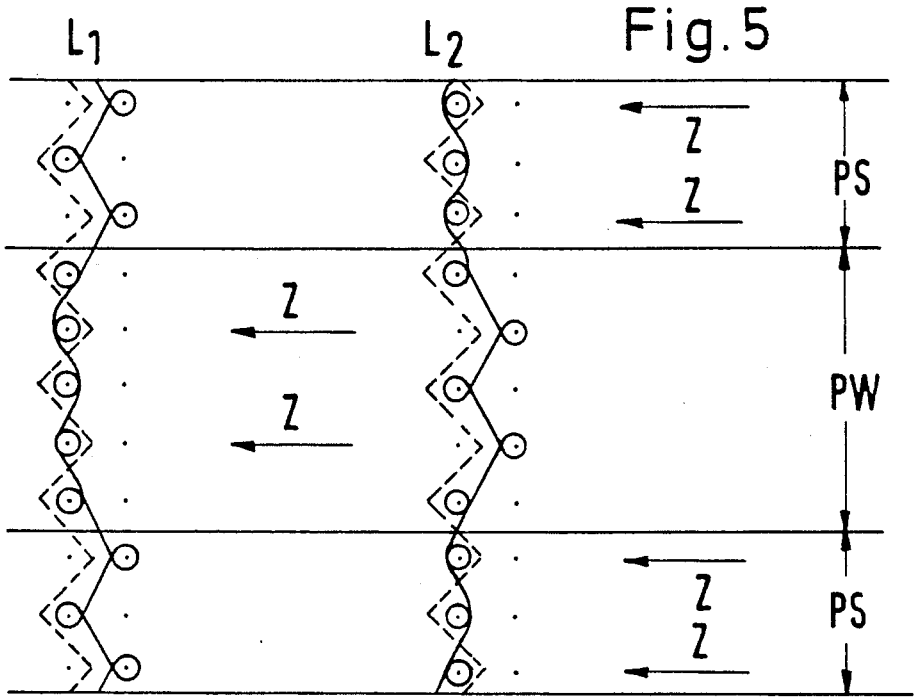
FIG. 5 is a lapping diagram for the varying working cycles of the warp knitting machine of FIG. 2.

FIG. 5 is directed toward a dual guide construction in accordance with FIG. 2. The jacquard control provides that alternately guide bars L1 and then L2 provide a tricot ground ware while, at the same time the other guide bars produce pile loops by means by a pillar lap. It will be seen that the threads of the pillar stitch cross the path of the pile sinkers. There is thus produced an area PW wherein the guide bar L1 produces the pile loops and an area PS where the guide bar L2 produces the pile loops Thus, if guide bar L1 carries white threads and guide bar L2 carries black threads an alternating black and white pile is provided.

Figure 9:
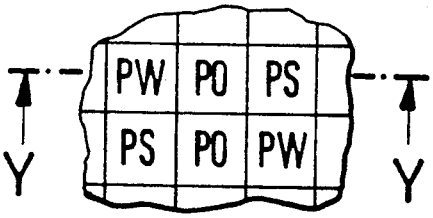
FIG. 9 is a schematic plan view of a fragment of the goods produced by the warp knitting machine of FIG. 2.
Figure 10:
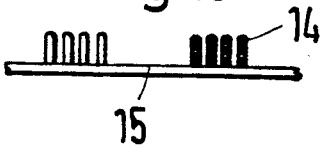
FIG. 10 is a cross-sectional view of the goods of taken along line Y—Y FIG. 9.
Figure 6:
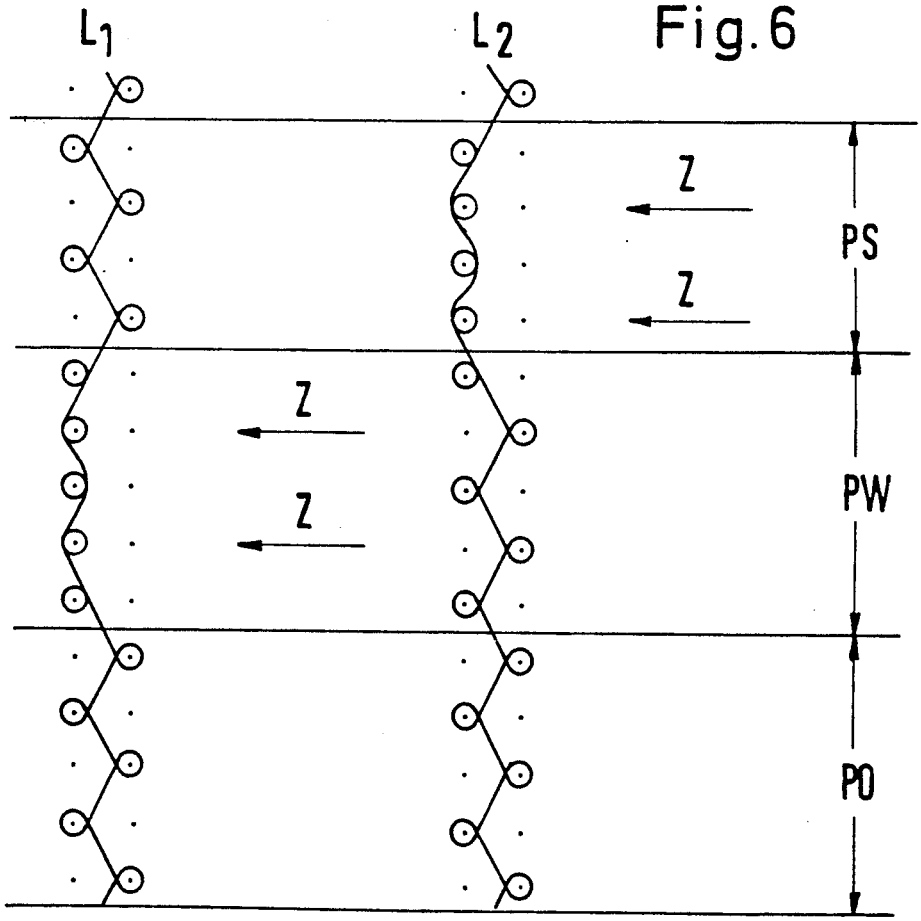
FIG. 6 is an alternate lapping diagram of various further working cycles for the warp knitting machine of FIG. 2.

In FIG. 6 the guides of FIG. 5 are programmed to provide another variation. In addition to the areas PS and PW, in which each guide bar produces pile, a third area P0 is provided where both guide bars produce the ground ware. There are thus produced three patterning categories. As may be seen from FIGS. 9 and 10 areas with different pile threads (areas PW and PS) alternate with areas with no pile loops. Furthermore, in FIG. 10 area PW contains white and area PS contains black pile loops.

FIGS. 7 to 10 show that the pile density variation of these areas can take place not only in the warp direction but also in the weft direction, which gives rise to a substantial number of patterning possibilities. In the examples, only unitary thread systems are considered. However, it is possible to set up a thread system in which particular color patterns or the like may be provided and thus, since these areas can be set up as desired by the jacquard controls, substantially unlimited patterning possibilities are available.

By maintaining the tricot ground stitch, the jacquard guide bars can produce Jersey stitch, as well as a pillar which again, causes the occurrence of pile loops by the crossing of the pile sinkers. The ground ware can also be laid in a stitch different from the tricot stitch, for example a Jersey or atlas when the displacement of pile sinkers is adjusted to accord with the ground stitch. In each case, a crossing of the pile sinkers is achieved by the displacement of the guides.

Figure 11:
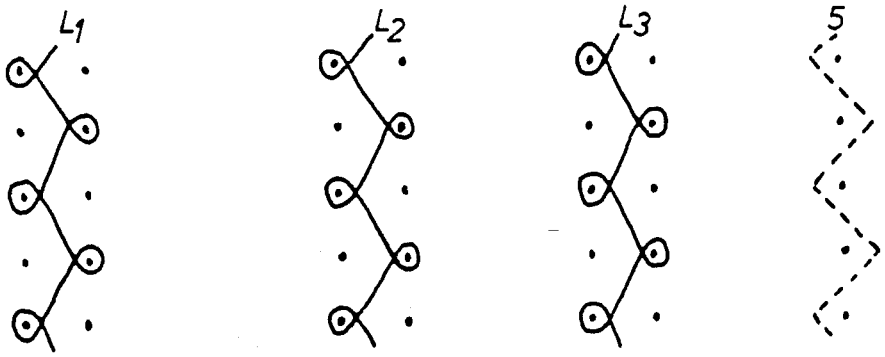
FIG. 11 is a lapping diagram showing the formation of ground ware as a tricot stitch for all three bars of FIG. 1.
Figure 12:
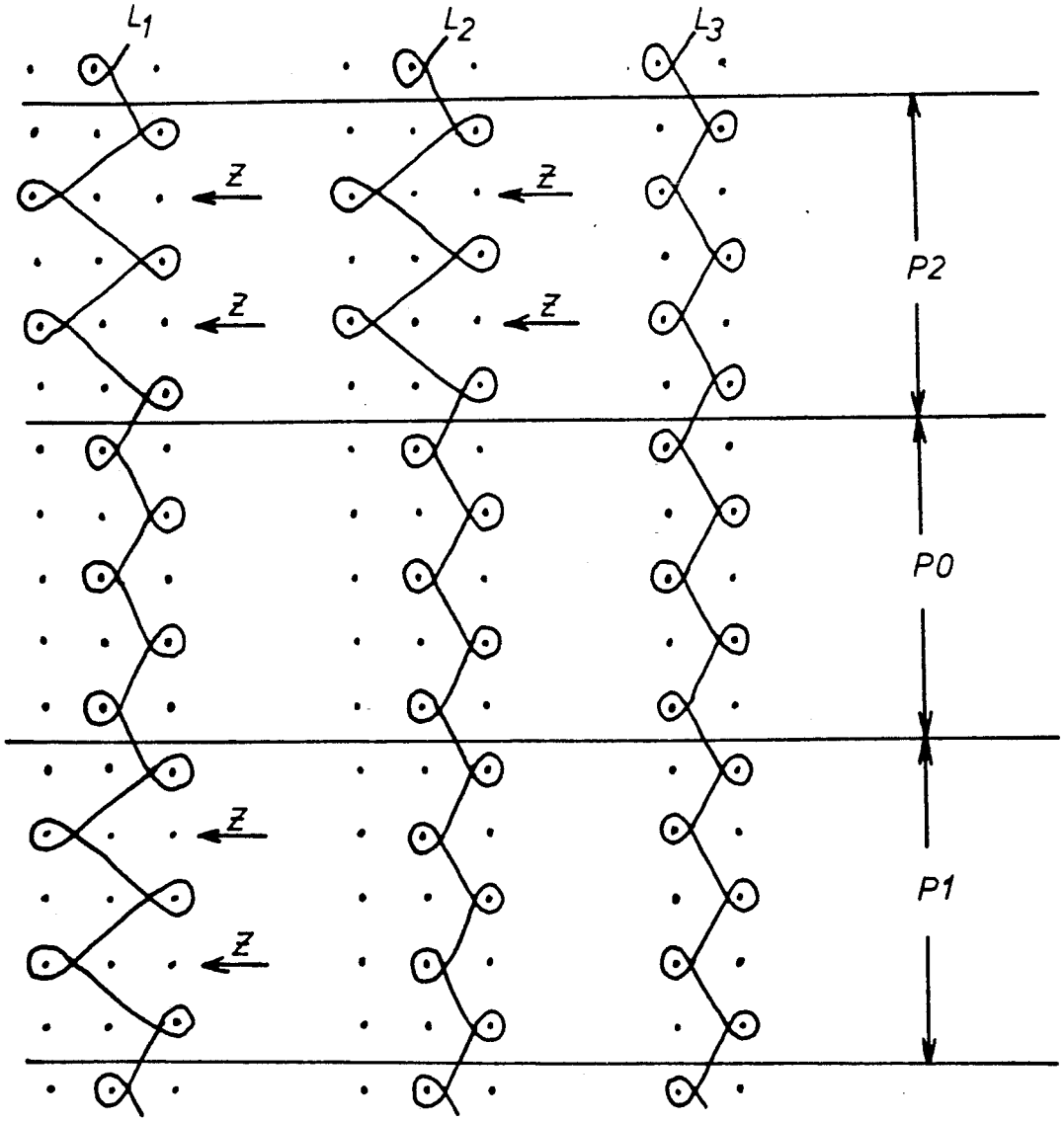
FIG. 12 is a lapping diagram that shows variations on the diagram of FIG. 11, wherein guides L1 and L2 are displaced to form a Jersey stitch.

Thus FIG. 11 is a lapping diagram showing the formation of ground ware as a tricot stitch for all three bars of FIG. 1. FIG. 12 shows in region P0 the same lapping sequence for all three guides. The jacquard induced change in the lapping diagram in region P2 shows guides L1 and L2 displaced as indicated at points Z to form a Jersey stitch. Guide L3 continues to make a tricot stitch in region P2. In region P1 only guide L1 is displaced to form the Jersey stitch, while guides L2 and L3 form a tricot stitch.

Figure 13:
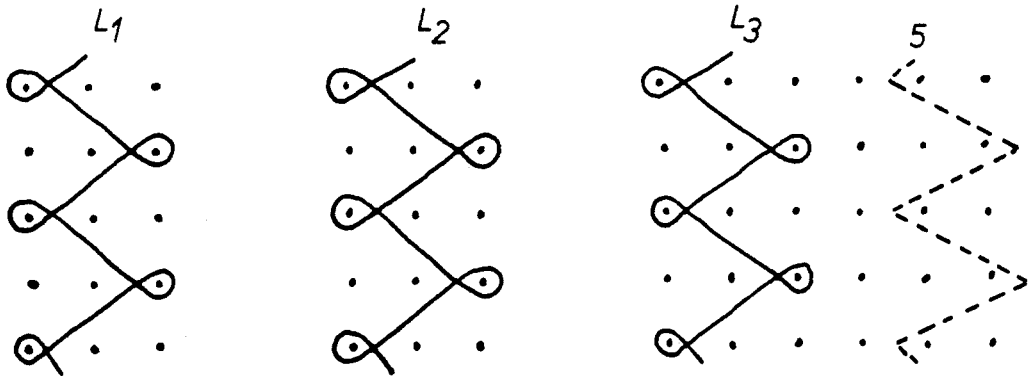
FIG. 13 is a lapping diagram showing the formation of ground ware as a Jersey stitch for all three bars of FIG. 1.
Figure 14:
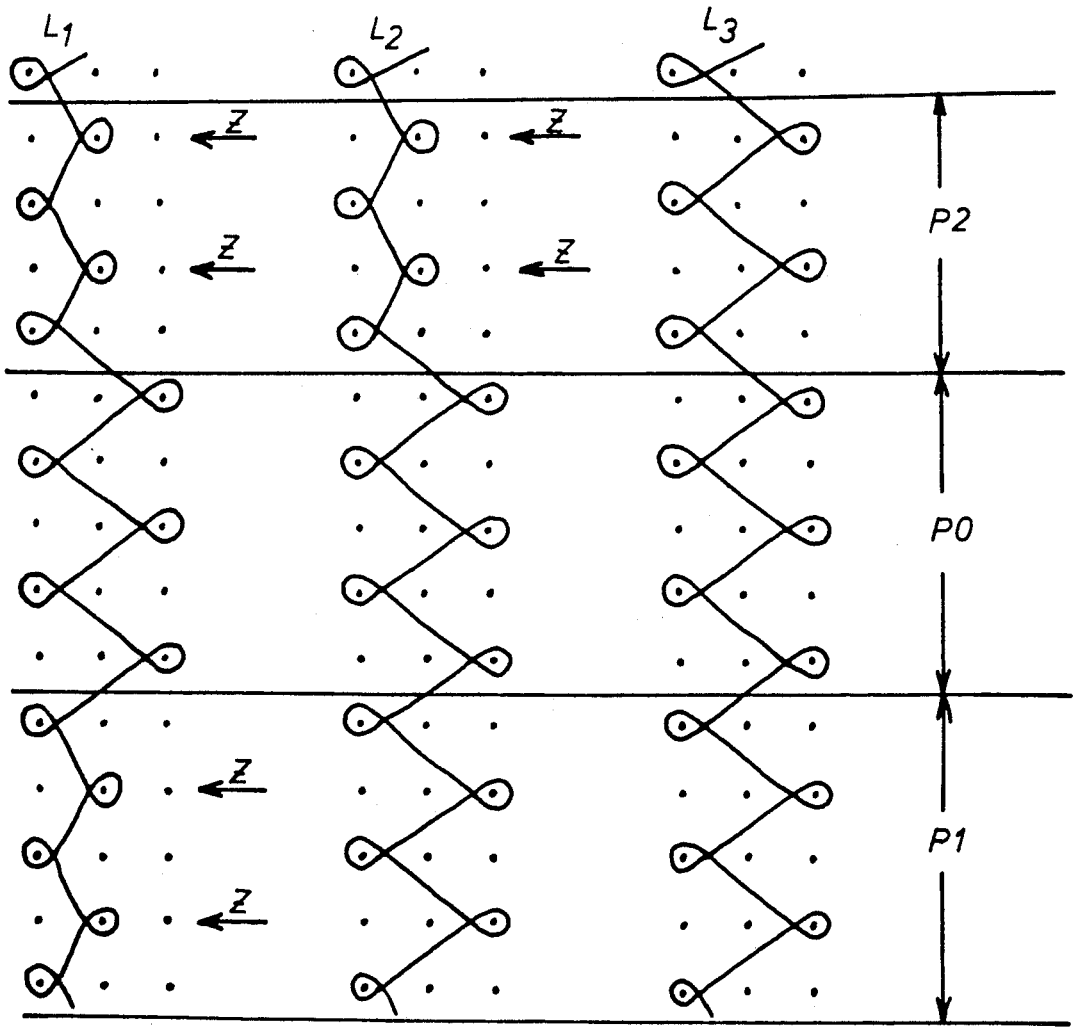
FIG. 14 shows a variation in the diagram of FIG. 13, with guide L1 in area P1 and P2 and guide bar L2 in area P2 displaced to form tricot stitches.

FIG. 13 is a lapping diagram showing the formation of ground ware as a Jersey stitch for all three bars of FIG. 1. The movement of the pile sinker bar is adapted to the ground lapping, as illustrated. FIG. 14 shows in region P0 the same lapping sequence for all three guides. FIG. 14 shows guide L1 in area P1 and P2 and guide bar L2 in area P2 displaced to form tricot stitches. The other guides continue to form a Jersey stitch.

Figure 15:
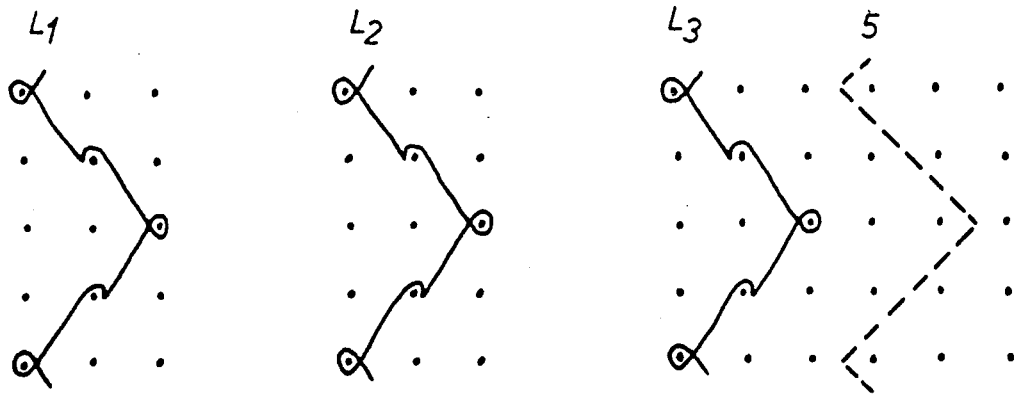
FIG. 15 is a lapping diagram showing the formation of ground ware as three rows of atlas stitches for all three bars of FIG. 1.
Figure 16:
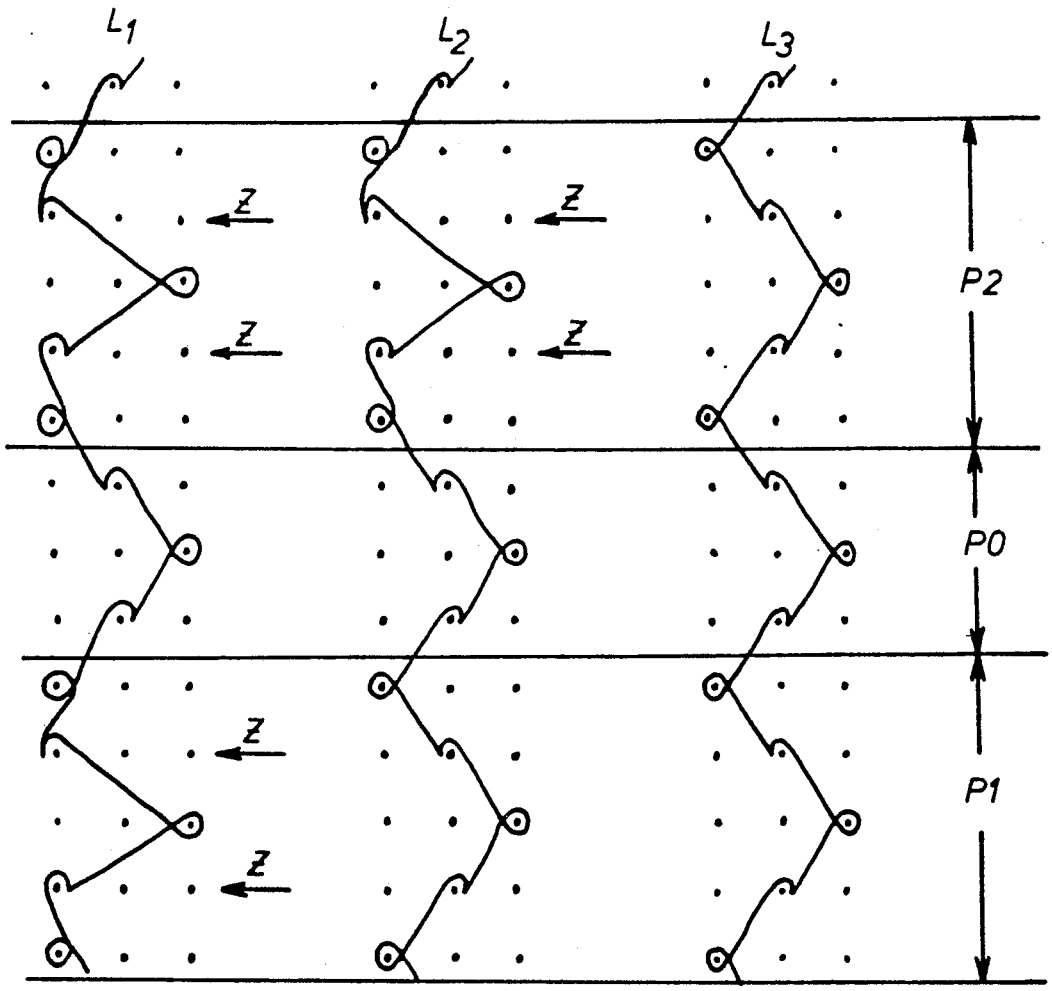
FIG. 16 shows displacement from the diagram of FIG. 15 in the atlas ground stitch in area P1 (by guide bar L1) and area P2 by guide bars L1 and L2.

FIG. 15 is a lapping diagram showing the formation of ground ware as three rows of atlas stitches for all three bars of FIG. 1. The atlas stitch is shown repeating over four machine cycles The movement of the pile sinker bar is adapted to the ground lapping, as illustrated. FIG. 16 shows displacement at points Z from the diagram of FIG. 15 in the atlas ground stitch in area P1 by guide bar L1; and in area P2 by guide bars L1 and L2.

Many modifications and variations of the present invention are possible in light of the above teachings Therefore within the scope of the appended claims, the invention may be practiced otherwise than as described.

I claim:

1. A warp knitting machine for producing pile ware with threads, comprising:

a pile sinker bar having a plurality of pile sinkers displaceable in the longitudinal direction, said pile sinkers being operable to hold and be encircled by pile loops; and at least two guide bars each having a plurality of guides, at least one of said guide bars (a) having jacquard guide means for displacing its guides and (b) being arranged to shog by an amount that selectively produces, in dependence upon the jacquard guide means, either ground ware or pile loops, ground ware being formed by laying the threads without crossing over said pile sinkers, pile loops being formed by laying the threads across the pile sinkers.

2. A warp knitting machine in accordance with claim 1 wherein the shogging of the jacquard guide means corresponds to the displacement of the pile sinker bar.

3. A warp knitting machine in accordance with claim 2 wherein said two guide bars each have jacquard guide means for displacing its guides to lay either ground ware or pile loops.

4. A warp knitting machine in accordance with claim 3 further comprising:

a third guide bar having rigidly affixed guides for forming ground ware, said jacquard guide means being selectively operable to lay pile loops in a general pattern.

5. A warp knitting machine in accordance with claim 3 wherein said two guide bars having jacquard guide means are selectively operable to form with either one the pile loops and with the other one ground ware.

6. A warp knitting machine in accordance with claim 2 wherein the shogging of said pile sinker bar and of said guide bar of said jacquard guide means is sized for tricot lapping and said guide bar of said jacquard guide means displaces its guides in the sense of pillar lap.

7. A process for producing warp knitted pile ware utilizing a warp knitting machine having a pile sinker bar, and at least two guide bars, at least one being a jacquard guide bar having a jacquard control system, including the steps of:

laying threads with said jacquard guide bar to form ground ware, under the influence of said jacquard control system, ground ware being formed by laying the threads without crossing over said pile sinkers; and alternately laying threads with said jacquard guide bar to form pile loops, under the influence of said jacquard control system, pile loops being formed by laying the threads across the pile sinkers, the pile sinkers and the jacquard guide bar shogging by an amount that selectively produces, in dependence upon the jacquard control system, either ground ware or pile loops.

8. A process according to claim 7 wherein said two guide bars are both jacquard guide bars with different thread systems, the process including the step of:

laying threads from both jacquard guide bars alternately as pile loops.

9. A process according to claim 7 wherein said two guide bars are both jacquard guide bars with different thread systems, and wherein the thread systems of the two jacquard guide bars comprise at least two pattern oriented thread types, further comprising the step of:

simultaneously laying threads with said two jacquard guide bars to form pile loops, under the influence of said jacquard control system, pile loops being formed by said two jacquard guide bars laying the threads across the pile sinkers, the pile sinkers and the two jacquard guide bars shogging by an amount that selectively produces, in dependence upon the jacquard control system, either ground ware or pile loops.

10. A process in accordance to claim 9 comprising the step of:

laying pile loops with the two jacquard guide bars lay threads by means of their jacquard controls either alternately or both at the same time.

11. Jacquard pile ware produced by warp knitting, the pile ware comprising:

ground ware and pile loops, said pile loops being arranged in a predetermined, arbitrary pattern with areas having pile loops and alternate areas devoid of pile loops, said pile loops being formed from threads which threads are stitched both: (a) in said areas having pile loops and (b) in said alternate areas devoid of pile loops.

12. Pile ware in accordance with claim 11 including areas devoid of pile loops alternate with areas having a predetermined density of pile loops and areas having pile loops at twice said predetermined density.

13. Jacquard pile ware produced by warp knitting, the pile ware comprising:

ground ware and pile loops from two thread systems, said pile loops being arranged in a predetermined, arbitrary pattern, said pile ware having a plurality of alternating areas either (a) devoid of pile loops, (b) occupied by pile loops from one of the thread systems or (c) occupied by pile loops from the other one of said thread systems, said pile loops being formed from threads which threads are stitched both: (a) in said areas having pile loops and (b) in said areas devoid of pile loops.

14. Pile ware in accordance with claim 13 wherein the alternation of areas can occur in the direction of the warp threads as well as perpendicular thereto.

15. Jacquard pile ware produced by warp knitting, the pile ware comprising:

ground ware and pile loops arranged with areas having pile loops and alternate areas devoid of pile loops, said areas devoid of pile loops alternating with areas having a predetermined density of pile loops and areas having pile loops at twice said predetermined density.

* * * * *